US005761745A

United States Patent [19]

Sato

[11] Patent Number: 5,761,745

[45] Date of Patent: Jun. 9, 1998

[54] GOLF GLOVE

[76] Inventor: Masataro Sato, 191, Ooaza Ikenobe, Miki-cho, Kita-gun Kagawa, Japan

[21] Appl. No.: 805,581

[22] Filed: Feb. 25, 1997

[30] Foreign Application Priority Data

Mar. 1, 1996 [JP] Japan ..... 8-044349

[51] Int. Cl.[6] ..... A41D 19/00

[52] U.S. Cl. ..... 2/161.2; 2/159

[58] Field of Search ..... 2/161.2, 159, 161.1, 2/161.6, 165, 163, DIG. 1

[56] References Cited

U.S. PATENT DOCUMENTS

| | | | |
|---|---|---|---|
| 889,397 | 6/1908 | O'Shaughnessy | 2/161.2 |
| 2,242,318 | 5/1941 | Mosier | 2/161.2 |
| 2,344,080 | 3/1944 | Burgett | 2/161.2 |
| 2,554,991 | 5/1951 | Kramer | 2/159 |
| 3,649,966 | 3/1972 | Shields | 2/159 |

FOREIGN PATENT DOCUMENTS 4-131609 12/1992 Japan .

*Primary Examiner*—Gloria M. Hale

*Attorney, Agent, or Firm*—Nikaido, Marmelstein, Murray & Oram LLP

[57] ABSTRACT

In a golf glove, openings are provided in those backside portions of middle, ring and little finger sections of the glove which correspond to second joints of a hand, thereby facilitating the bending and flexing of middle, ring and little fingers. Thus, it is possible to firmly and stably grasp a grip of a golf glove without feeling a sense of oppression to the hand.

4 Claims, 5 Drawing Sheets

GOLF GLOVE

BACKGROUND OF THE INVENTION

1. Field of the Invention

The present invention relates to a new golf glove formed to enable a golfer to stably and firmly grasp a grip of a golf club.

2. Description of the Related Art

There is a conventionally known golf glove having a plurality of openings provided in finger sections (for example, see Japanese Utility Model Application Laid-open No.4-131609).

In general, when a golfer grasps a grip of a golf club in order to hit a ball, he or she strongly and firmly grasps the grip by three fingers, i.e., middle finger (third finger), ring finger (fourth finger) and little finger (fifth finger) of the hand of one arm which leads the golf club (the left arm in a case of a right-handed golfer, and the right arm in a case of a left-handed golfer), while grasping the grip by the remaining thumb and index finger (pollex and second finger) more weakly than the three fingers in such a manner that the two fingers are lightly put on the grip. Thus, it is possible for the golfer to stably swing the golf club through a correct path and to correctly hit the ball.

However, the known golf glove is ordinarily made from a material having a less expandability such as a natural leather, a synthetic leather and the like. When the golfer wears such golf glove and grasps a grip 13 of a golf club as above-described, the three fingers: the middle, ring and little fingers are each crooked at particularly second joints thereof by an acute angle thereby to relatively strongly grasp the grip 13, as shown in FIG. 5. This arises a problem that a tension T is produced in a back side of the glove, particularly, back-side portions of a middle finger section 06, a ring finger section 07 and a little finger section 08 of the glove, giving a sense of oppression to these fingers. This makes it hard to grasp the grip to exert an influence to the swinging of the golf club and to accelerate the fatigue of the golfer's hand. Even if a plurality of openings are provided in the finger sections, as shown in the above-described Japanese publication, the disclosed golf glove only has an air-permeable function, and cannot solve the above problem.

SUMMARY OF THE INVENTION

Accordingly, it is an object of the present invention to provide a new golf glove, which ensures that a golfer wearing the golf glove can reliably grasp a grip of a golf club without feeling a sense of oppression on his or her hand, thereby solving the above problem.

To achieve the above object, according to a first aspect and feature of the present invention, there is provided a golf glove, comprising a thumb finger section, an index finger section, a middle finger section, a ring finger section and a little finger section, the golf glove covering substantially an entire area of a hand of a golfer when the golfer wears the golf glove, back-side portions of the middle, ring and little finger sections corresponding to second joints of said hand being provided with openings for facilitating bending and flexing of a middle finger, a ring finger and a little finger of said hand.

With the above construction, since the openings for facilitating the bending and flexing of the middle, ring and little fingers of the hand are provided in those back-side portions of the middle, ring and little finger sections which correspond to the second joints of the middle, ring and little fingers of the hand, a golfer wearing this golf glove can firmly and stably grasp a grip of a golf club without feeling a sense of oppression, and the fatigue of his or her hand can be moderated. The second joints of the fingers are referred to medically as the "proximal interphalangeal joints" of the fingers.

In addition, to achieve the above object, according to the present invention, in the above construction, the openings are each defined into an elliptic shape longer in directions of the middle, ring and little finger sections.

With such feature of the present invention, the tension in the middle, ring and little finger sections is effectively moderated by the relatively small openings defined into the elliptic shape longer in the directions of the fingers.

Further, to achieve the above object, according to the present invention, in the above-construction, peripheral edges of the openings are each hemmed by a trimming band.

With such construction, the openings can be reinforced by hemming the peripheral edges of the openings by the trimming band. In addition, the golf glove is easily worn, and the design effect can be enhanced.

Yet further, to achieve the above object, according to the present invention, in the above construction, each of the openings is covered with an air-permeable, expandable piece.

With such feature, the heat insulating property for the hand can be enhanced without hindering the above-described features, and the openings can be reinforced. Moreover, the golf glove is easily worn, and the design effect can be enhanced.

The above and other objects, features and advantages of the invention will become apparent from the following description of the preferred embodiments taken in conjunction with the accompanying drawings.

DETAILED DESCRIPTION OF THE PREFERRED EMBODIMENTS

The present invention will now be described by way of preferred embodiments with reference to the accompanying drawings.

Figure 1:
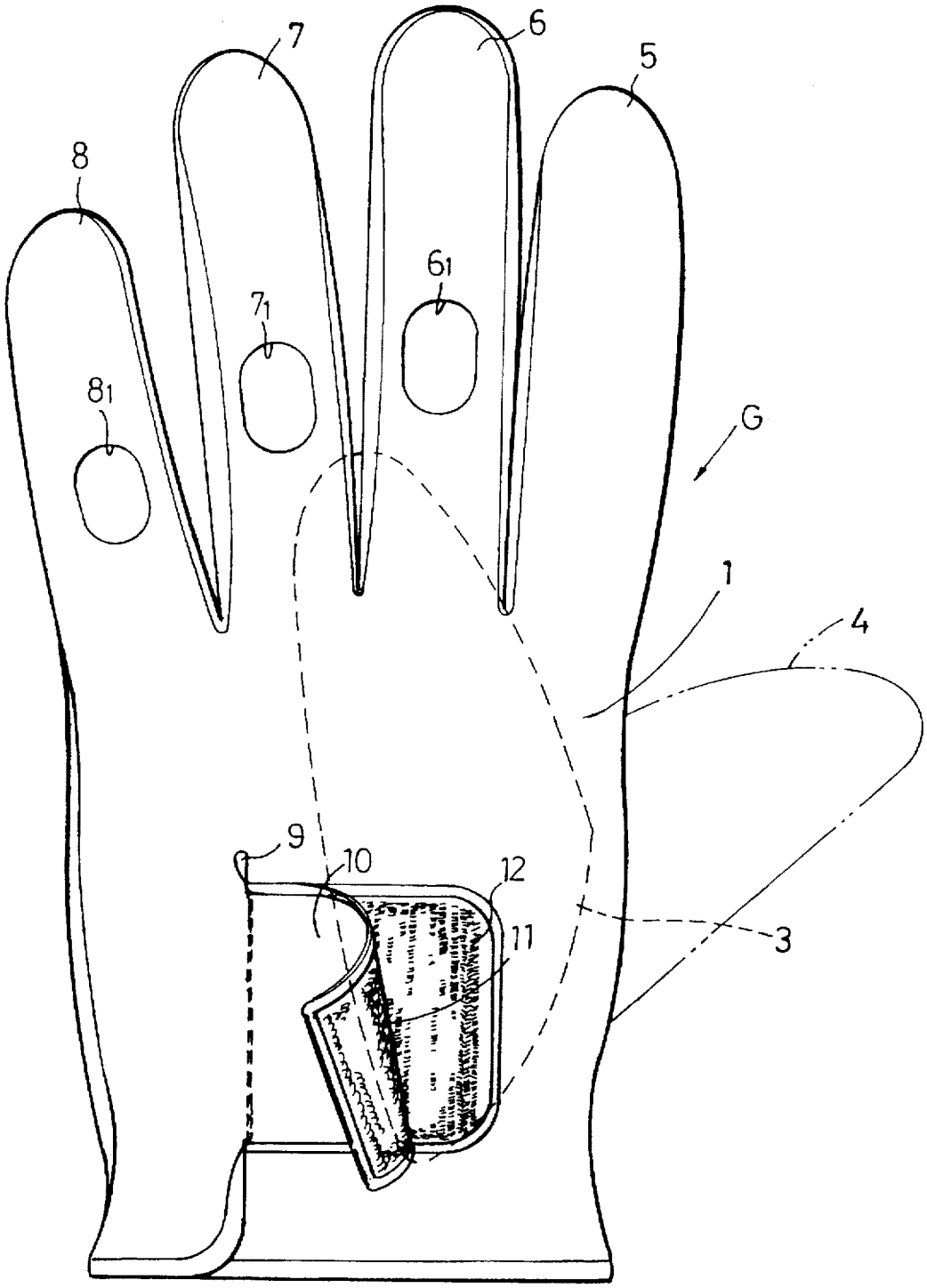
FIG. 1 is a front view of a golf glove according to a first embodiment of the present invention.
Figure 2:
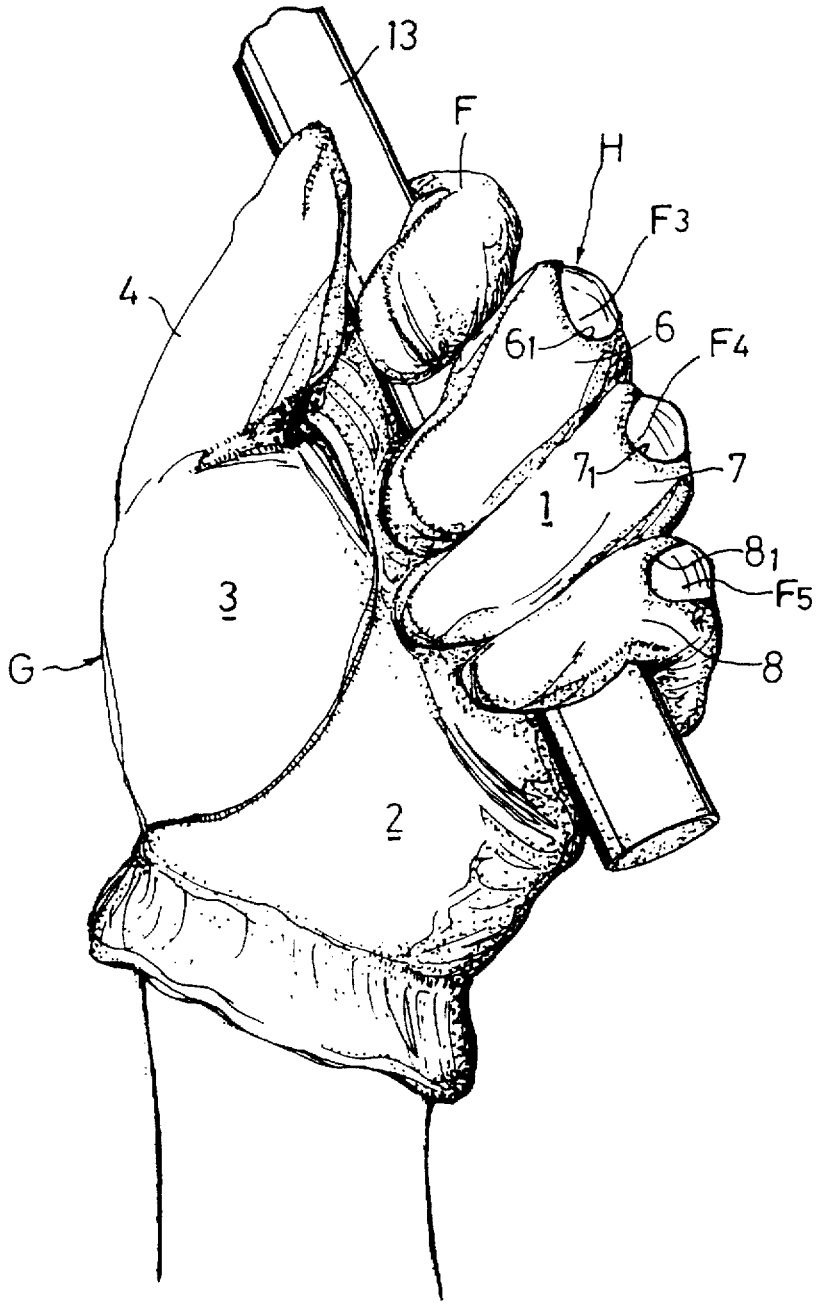
FIG. 2 is a perspective view of the golf glove according the first embodiment in a state in which a golfer wearing the glove has grasped a grip of a golf club.

A golf glove G according to a first embodiment shown in FIGS. 1 and 2 is formed from a sheet material having a relatively small elongation such as a natural leather, a synthetic leather, textiles and the like, and includes five finger sack sections: a thumb sack section 4, an index finger sack section 5, a middle finger sack section 6, a ring finger sack section 7 and a little finger sack section 8. The golf glove G is formed to cover substantially the entire area of a hand H by integrally sewing three elements together: a back section element 1 made by cutting with integral sections corresponding to backs of four fingers excluding thumb, as usual, a palm section element 2 made by cutting with integral sections corresponding to pads of four fingers excluding thumb, and a thumb section element 3.

Those back-side portions of the middle finer, ring finger and little finger sack sections 6, 7 and 8 which correspond to second joints or knuckles of the hand H are provided with elliptic openings $6_1$, $7_1$ and $8_1$ which are longer in directions of the fingers. Thus, when the glove G is worn on the hand H, those back-side portions of middle (third) finger $F_3$, ring (fourth) finger $F_4$ and little (fifth) finger $F_5$ of the hand which correspond to the second joints are exposed to the outside through the openings $6_1$, $7_1$ and $8_1$.

A slit 9 is provided in the back section element 1 to extend from a wrist-side peripheral edge toward the center of the back portion, as usual, and a stop tongue piece 10 is sewn to one of edges of the slit 9, so that it can be folded back. Face-fasteners 11 and 12 are mounted on an inner surface of the stop tongue piece 10 and on a back-side surface of the back section element 1, respectively, so that they can be brought into and out of contact with each other.

The golf glove G constructed as described above is worn on the hand H of one arm other than the more-skilled arm of a golfer, i.e., the arm positioned forward in a ball-carrying direction (a left arm in a case of a right-handed golfer, and a right hand in a case of a left handed golfer). When a golfer wears the golf glove G on his or her hand H and grasps a grip 13 of a golf club, three fingers: middle finger $F_3$, ring finger $F_4$ and little finger $F_5$ of the golfer's hand H relatively strongly grasp the grip 13 and hence, second joint portions of the fingers $F_3$, $F_4$ and $F_5$ are crooked at acute angles, as shown in FIG. 2, so that the backs of the finger sections 6, 7 and 8 corresponding to these fingers are not pulled, because the openings $6_1$, $7_1$ and $8_1$ permitting the second joints to be exposed to the outside are provided in those back-side portions of the middle, ring and small finger sections 6, 7 and 8 of the glove G which correspond to the second joints. Thus, the glove G ensures that the golfer easily grasps the grip 13 without feeling a sense of oppression at the hand. Moreover, even if the golfer grasps for a long time, the golfer's hand cannot become fatigued, which can contribute to an enhancement in score. Particularly, by the fact that the openings $6_1$, $7_1$ and $8_1$ are defined in an elliptic shape elongated in the directions of these fingers, as in the embodiment, the above-mentioned function is achieved through the openings having a relatively small area.

Figure 3:
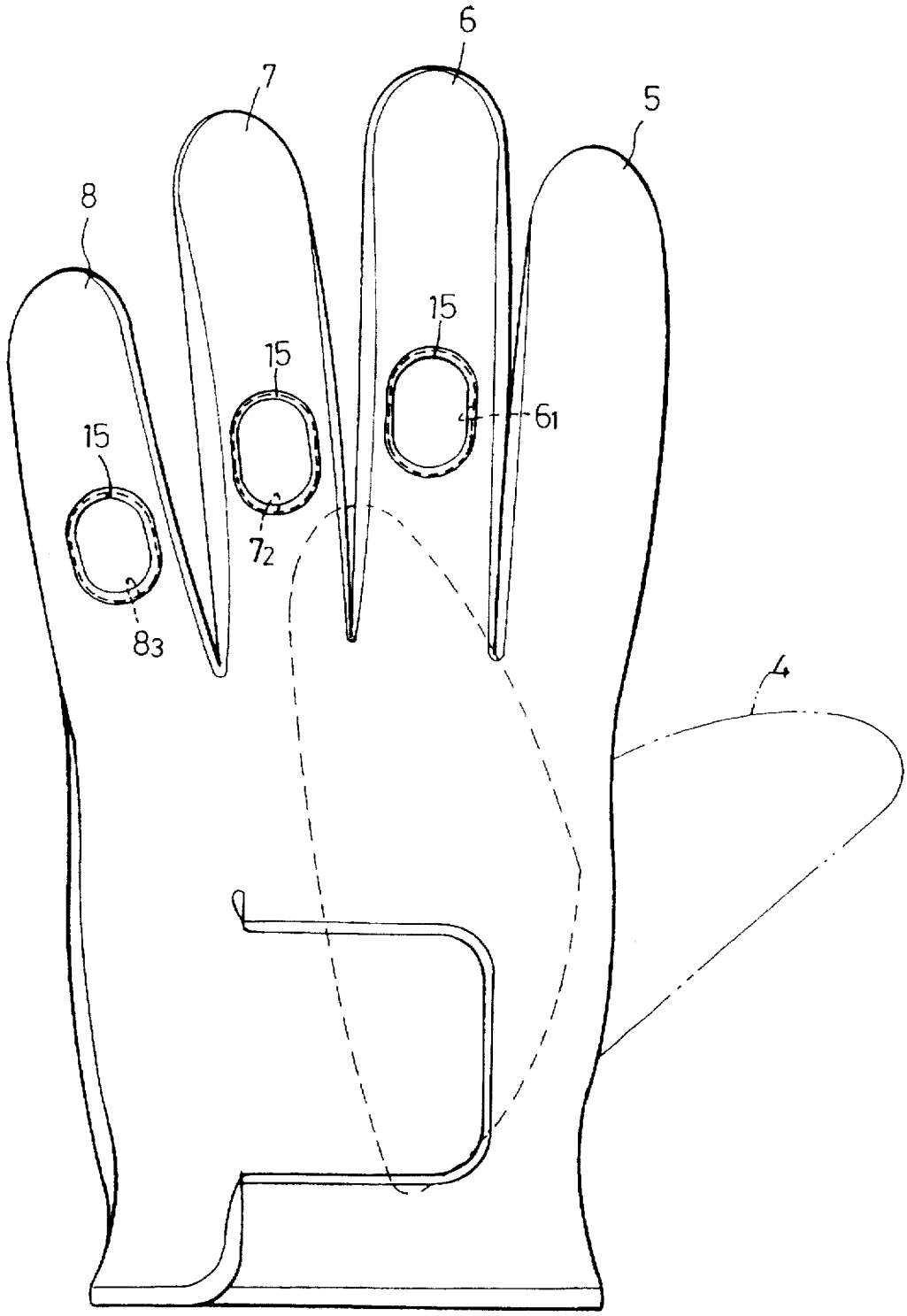
FIG. 3 is a front view of a golf glove according to a second embodiment of the present invention.

FIG. 3 is a front view showing a second embodiment of a golf glove according to the present invention. In FIG. 3, portions or sections corresponding to those in the first embodiment are designated by like reference characters.

In the second embodiment, openings $6_1$, $7_1$ and $8_1$ in the middle, ring and little finger sections 6, 7 and 8 are hemmed by sewing a trimming band 15 to peripheral edges of the openings $6_1$, $7_1$ and $8_1$. Thus, the openings $6_1$, $7_1$ and $8_1$ can be reinforced, and the golf glove G is easily worn on the hand. Further, the design effect can be enhanced by using a trimming band having various qualities and colors.

Figure 4:
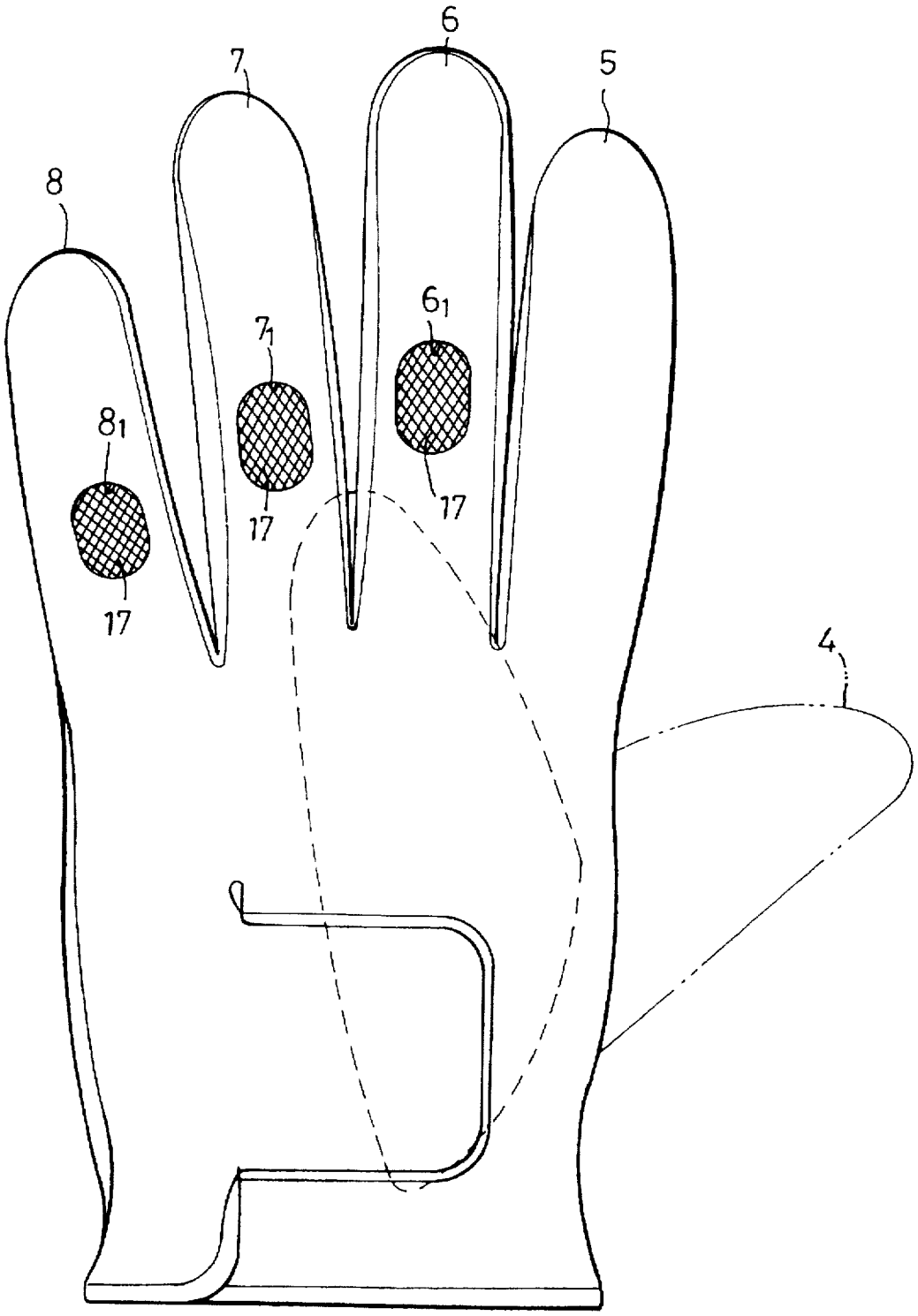
FIG. 4 is a front view of a golf glove according to a third embodiment of the present invention.
Figure 5:
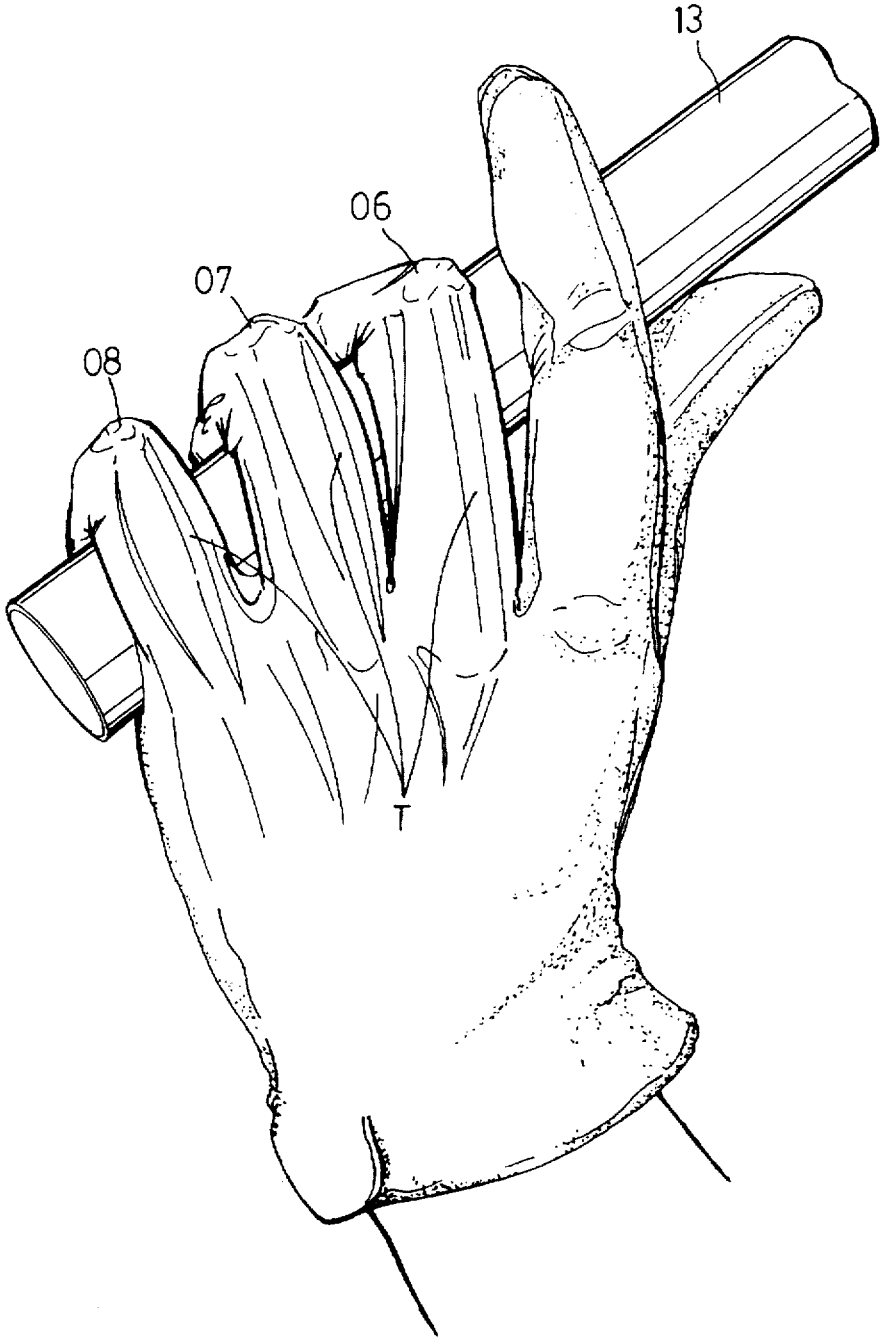
FIG.5 PRIOR ART
FIG. 5 is a perspective view of the conventional golf glove in a state in which a golfer wearing the glove has grasped a grip of a golf club.

FIG. 4 is a front view illustrating a third embodiment of a golf glove according to the present invention. In FIG. 4, portions or sections corresponding to those in the first embodiment are designated by like reference characters.

In the third embodiment, openings $6_1$, $7_1$ and $8_1$ in the middle, ring and little finger sections 6, 7 and 8 are covered with an air-permeable expansion piece 17. Thus, the heat insulating function is enhanced without hindering the above-described features of the glove G, which makes it suitable to utilize the glove G in the winter season. As in the second embodiment, the openings $6_1$, $7_1$ and $8_1$ can be reinforced, and the golf glove G is easily worn on the hand. Further, the design effect can be enhanced by using an expansion piece having various qualities and colors.

Although the embodiments of the present invention have been described, it will be understood that the present invention is not limited to the above-described embodiments, and various modifications in design may be made within the spirit and scope of the invention defined in claims. For example, in the embodiments, the openings are formed into an elliptic shape longer in the direction of the fingers, but they may be formed into a circular shape or any other shape. In addition, openings may be provided also in back-side portions of the thumb and index finger sections corresponding to the second joints. Further, of course, the golf glove may be formed for wearing on the hand of an arm positioned rearward in the ball-carrying direction, i.e., a more-skilled arm of a golfer.

What is claimed is:

1. A golf glove, comprising a thumb finger section, an index finger section, a middle finger section, a ring finger section and a little finger section, the golf glove covering substantially an entire area of a hand and fingers of a golfer when the golfer wears said golf glove, wherein back-side portions of the middle, ring and little finger sections corresponding to second joints of middle, ring and little fingers of said hand are provided with openings for facilitating bending and flexing of the middle finger, ring finger and little finger of said hand.

2. A golf glove according to claim 1, wherein said openings are each defined into an elliptic shape longer in directions of the middle, ring and little finger sections.

3. A golf glove according to claim 1, wherein peripheral edges of said openings are each hemmed by a trimming band.

4. A golf glove according to claim 1, wherein each of said openings is covered with an air-permeable, expandable piece.

* * * * *